US005301822A

United States Patent [19]

Coleman et al.

[11] Patent Number: 5,301,822

[45] Date of Patent: Apr. 12, 1994

[54] MAGNETIC TOOL HOLDER

[75] Inventors: Edward S. Coleman, Ridgefield; Richard Scalise, Westport, both of Conn.

[73] Assignee: Ullman Devices Corporation, Ridgefield, Conn.

[21] Appl. No.: 20,711

[22] Filed: Feb. 22, 1993

[51] Int. Cl.[5] ..... A47F 5/00

[52] U.S. Cl. ..... 211/70.6; 211/DIG. 1; 248/37.6; 248/309.4; 248/206.5; 335/285

[58] Field of Search ..... 211/70.6, 70.7, 87, 211/DIG. 1; 248/37.3, 37.6, 309.4, 206.5; 335/285

[56] References Cited

U.S. PATENT DOCUMENTS

| | | | |
|---|---|---|---|
| 2,565,625 | 8/1951 | Phelon | 211/70.6 X |
| 3,229,820 | 1/1966 | Hentzi et al. | 211/70.6 |
| 3,363,775 | 1/1968 | Shaw | 211/70.6 |
| 3,514,731 | 5/1970 | Drake | 248/206.5 X |
| 3,776,387 | 12/1973 | Brent | 211/70.6 |
| 3,827,021 | 7/1974 | Phelon | 248/309.4 X |
| 3,842,980 | 10/1974 | Kushner | 211/DIG. 1 X |
| 4,544,067 | 10/1985 | Miller | 211/70.6 |
| 4,586,616 | 5/1986 | Cooper et al. | 248/206.5 X |
| 4,802,580 | 2/1989 | Anderson | 211/70.6 X |

*Primary Examiner*—Robert W. Gibson, Jr.
*Attorney, Agent, or Firm*—Bachman & LaPointe

[57] ABSTRACT

A magnetic tool holder includes a generally elongate body member having a first surface and a second surface and having a longitudinal channel running along at least a portion of the first surface; a receiving magnet, disposed in the longitudinal channel; and detent structure provided on the receiving magnet and the longitudinal channel, whereby the receiving magnet is held in place in the longitudinal channel when the detent structure on the receiving magnet and the longitudinal channel are engaged. A mounting magnet is disposed on the second surface, whereby the tool holder can be magnetically mounted to a metallic work surface. The detent structure may preferably include at least one indentation disposed along at least one side of the receiving magnet, and at least one projection disposed along at least one inner side surface of the longitudinal channel for engaging the indentation of the receiving magnet.

16 Claims, 1 Drawing Sheet

MAGNETIC TOOL HOLDER

BACKGROUND OF THE INVENTION

The invention relates to the tool industry and, particularly, to a magnetic tool holder for holding metallic tool elements such as sockets for socket wrenches and the like, which tool holder can be magnetically affixed to a desired ferrous metallic surface to allow convenient selection of tool elements.

Numerous devices are known in the art for storing tools. Such devices are as varied as the tools for which they are intended.

The use of magnets to store such tools and to position the device is also generally known as shown, for example, in U.S. Pat. No. 5,080,230 to Winnard.

The device disclosed in U.S. Pat. No. 5,080,230 also possesses several of the drawbacks common to the prior art devices. Namely, it is designed specifically for a particular type of tool (sockets for socket wrenches), and it involves complicated production caused by the cover member of non-metallic binding material having embedded magnetic particles, and the body member which requires numerous bore holes of different size for tool elements.

It is desirable to provide a tool holder possessing the advantages of magnetic positioning and holding for tools, which holder is not limited to a specific tool type.

It is further desirable to provide such a device which is simple in manufacture and well suited to automated production in large volumes.

It is, therefore, the primary object of the present invention to provide a magnetic tool holder which is "universal" in that it can be used to store or carry any type of metallic tool or the like.

It is a further object of the present invention to provide such a magnetic tool holder which is simple in manufacture so as to be well suited to automated manufacture in high volumes.

Other objects and advantages will appear hereinbelow.

SUMMARY OF THE INVENTION

The foregoing objects and advantages are readily attained by the disclosed invention.

The magnetic tool holder, according to the invention, comprises a generally elongate body member having a first surface and a second surface and having a longitudinal channel running along at least a portion of the first surface; a receiving magnet, disposed in the longitudinal channel; and detent means provided on the receiving magnet and the longitudinal channel, whereby the receiving magnet is held in place in the longitudinal channel when the detent means on the receiving magnet and the longitudinal channel are engaged.

The magnetic tool holder preferably further comprises means for mounting the tool holder, disposed on the second surface, whereby the tool holder can be mounted to a work surface.

The mounting means preferably includes a mounting magnet disposed on the second surface, whereby the tool holder can be magnetically mounted to a metallic work surface.

The tool holder preferably has plate means, disposed in the longitudinal channel between the receiving magnet and the inner side surfaces of the longitudinal channel, the plate means having dimple means disposed thereon for defining at least one indented portion on one side of the plate means and for defining an extended portion on the other side of the plate means, wherein the projection of the longitudinal channel engages the indented portion of the plate means, and the extended portion of the plate means engages the at least one indentation of the receiving magnet, whereby the receiving magnet and the plate means are held in place in the longitudinal channel.

Such plate means may also preferably serve as pole pieces for augmenting the magnetic attraction of the receiving magnet.

The foregoing structure allows the magnetic tool holder to be assembled and held together with minimal or no use of glues or other such adhesives or fasteners. Rather, the device of the present invention is primarily held together by the indentation structure of the body, plates and receiving magnet.

BRIEF DESCRIPTION OF THE DRAWINGS

A detailed description of a preferred embodiment of the invention follows, with reference to the attached drawings, wherein.

DETAILED DESCRIPTION

The invention relates to a magnetic tool holder which is simple in manufacture and which has a mounting surface, preferably a magnetic mounting surface, for positioning the tool holder, and a magnetic receiving surface for receiving various metallic tool elements as desired. As will be further described hereinbelow, the tool holder has a structure which, advantageously, allows the holder to be assembled with minimal use of conventional adhesives or the like.

Figure 1:
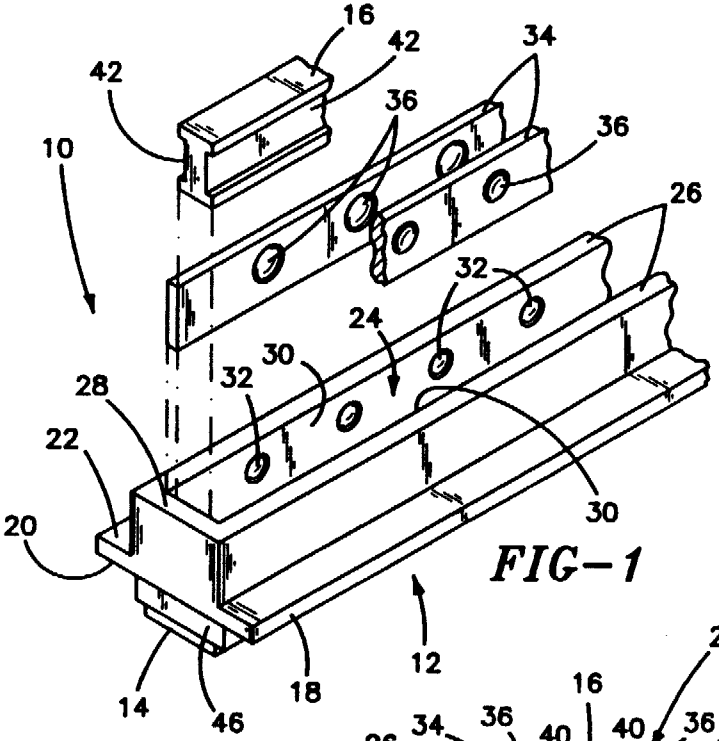
FIG. 1 is an exploded perspective view of a magnetic tool holder, according to the invention.

Referring to FIG. 1, a magnetic tool holder, generally indicated by reference numeral 10, is shown in exploded form to provide an illustration of the various elements and assembly of holder 10, according to the invention.

Holder 10 has a generally elongate body member 12. Body member 12 operatively holds mounting magnet 14 on one side, so that holder 10 can be positioned on any ferrous metallic surface (not shown) such as a metallic work bench or shelf, a car or other vehicle, or any other suitable location as desired. Body member 12 also holds receiving magnet 16 on another side so that holder 10 can be used as a "universal" holder, that is, to carry a wide assortment of tools and tool elements of various shape, size and use.

As shown, body 12 is preferably a generally flat elongate base 18 having a mounting surface 20 and a receiving surface 22. Body 12 may be made of any desired material such as, for example, plastic, aluminum, or the like, and may be flexible or non-flexible as desired. A longitudinal channel 24 is preferably defined on receiving surface 22. Channel 24 is preferably defined by two substantially parallel arms 26 extending from receiving surface 22 substantially perpendicular to receiving surface 22. Channel 24 may also preferably be closed at ends 28 as shown in FIG. 1. Channel 24 serves to receive receiving magnet 16, and preferably plates 34 as shown in the drawings, on receiving surface 22. Arms 26 and ends 28 serve to position receiving magnet 16 against sliding relative to body member 12.

A detent structure is preferably disposed between receiving magnet 16 and longitudinal channel 24. That is, projections and indentations are preferably disposed on the receiving magnet 16 and longitudinal channel 24. The detent structure of receiving magnet 16 and longitudinal channel 24 engage so as to hold receiving magnet 16 in longitudinal channel 24. The drawings illustrate a preferred embodiment of the invention, wherein the detent structure of the longitudinal channel 24 includes projections 32 formed on inwardly facing opposed surfaces 30 of arms 26. Projections 32 may preferably be a number of spaced bumps or knobs on at least one inwardly facing surface 30 of arms 26.

As shown in FIG. 1, an elongate plate 34 is preferably disposed in channel 24 between receiving magnet 16 and each surface 30. Plates 34 serve as pole pieces to augment the operation of receiving magnet 16. FIG. 1 shows plate 34 and receiving magnet 16 in an exploded view, with a portion of one plate 34 broken away to show the other plate in better detail.

Plate 34 preferably has punched in or dimple sections 36. Dimple sections 36 engage with the detent structure of receiving magnet 16 and longitudinal channel 24. Dimple sections 36 preferably define indented portions on the outwardly facing surface of plate 34 (facing arms 26), and define extended portions on the inwardly facing surface (facing receiving magnet 16).

Figure 2:
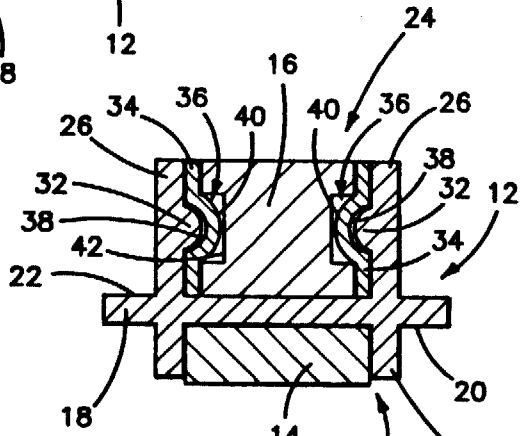
FIG. 2 is a cross-section of a magnetic tool holder, according to the invention.

FIG. 2 is a cross-section of holder 10 which more clearly illustrates the above described structure. FIG. 2 shows inwardly facing surfaces 30 of arms 26 with projections 32, and also shows plates 34 with dimple sections 36 defining indented portions 38 facing projections 32, and also defining extended portions 40 facing receiving magnet 16.

As shown in both FIGS. 1 and 2, the detent structure of receiving magnet 16 preferably includes indentations 42 formed along sides of receiving magnet 16. Indentations 42 may suitably by a continuous channel, as shown in the drawings, or could be a series of indentations aligned with extended portions 40 of plates 34.

Figure 4:
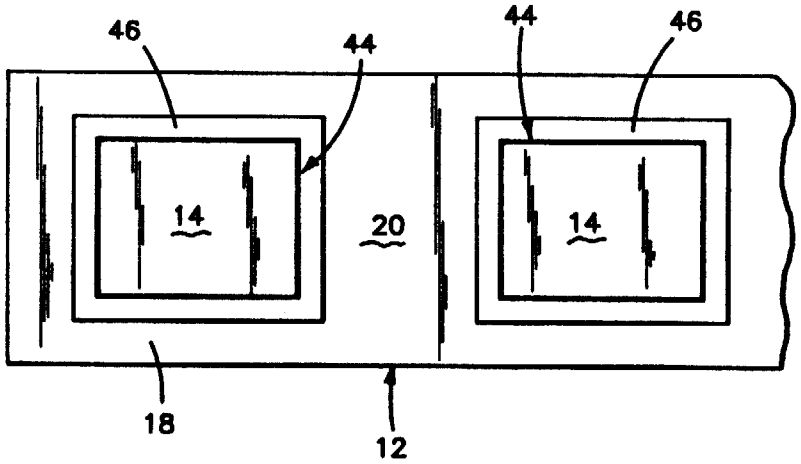
FIG. 4 is a bottom view of a magnetic tool holder, according to the invention.

Mounting magnet 14 may be affixed to mounting surface 20 through any suitable means. Preferably, mounting magnet 14 is disposed within enclosures 44 formed on mounting surface 20. FIG. 4 shows a bottom view of holder 10 illustrating mounting magnets 14 disposed in enclosures 44. Enclosures 44 are preferably defined by a wall 46 approximating the periphery of mounting magnet 14. Of course, wall 46 need not be continuous as shown, and could suitably be a series of wall segments or posts (not shown) which would serve equally to position mounting magnets 14 so as to substantially prevent lateral displacement of mounting magnet 14 relative to body member 12. Mounting magnets 14 may be held in enclosures 44 through any suitable and convenient means such as, for example, adhesives, press fit, bolts, screws, rivets or the like.

Mounting magnet 14 may be a single magnet mounted along mounting surface 20, or could be a series of magnet segments, as shown in the drawings. Providing a series of mounting magnets 14 in enclosures 44 may be desirable if non-flexible magnets are to be used so that incidental flexation of body 12 will not cause damage to non-flexible magnets.

Of course, receiving magnet 16 could likewise be formed of segments as well or, as in the preferred embodiment, may be a rubberized or flexible magnet.

It should be noted that when holder 10 is assembled as described, receiving magnet 16 and plates 34 are held in body 12 by the detent structure with a minimal use of adhesive or other conventional and undesirable fasteners. Thus, receiving magnet 16 and plates 34 are held in body member 12 primarily through structural means. This allows for greatly simplified manufacture of holder 10. Such manufacture can be automated without the added complication of a step of applying adhesives or fasteners, and without requiring provision of manufacturing hardware to supply such adhesives or fasteners. Such automation, according to the invention, would only call for, and could be accomplished by, the simple step of snapping the various elements together.

It should be pointed out that the detent structure could, of course, have projections 32, dimple sections 36 and indentations 42, which are directed outwardly as opposed to the embodiment shown in the drawings. That is, receiving magnet 16 could have a series of knobs or a ridge, rather than indentation 42, which ridge or knobs would extend into indentations formed on plates 34 by reversed dimple sections 36, which reversed dimple sections would project into grooves or indentations (not shown) positioned along the inside surface 30 of arms 26.

Figure 3:
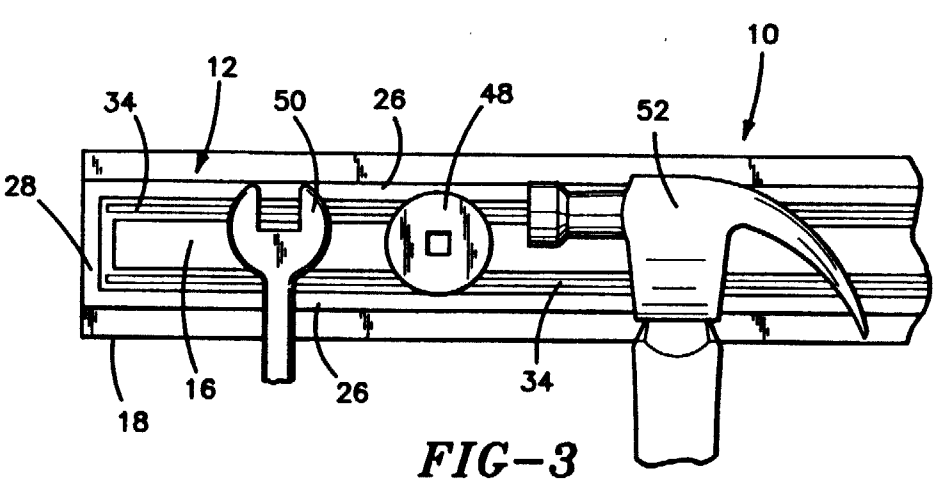
FIG. 3 is a side view of a magnetic tool holder holding assorted tools, according to the invention.

Additionally, receiving magnet 16 is, according to the invention, a universal holder which is suitable for holding any desired ferrous metallic items such as, as illustrated in FIG. 3, a wrench 50, a socket 48 for a socket wrench, a hammer 52, or the like. Obviously, this list is certainly given by way of example only and is by no means exhaustive regarding the tools or tool elements for which holder 10 may advantageously be used.

It should additionally be noted that mounting magnets 14 may preferably be stronger than receiving magnets 16. This provides a stronger attachment of holder 10 to a work surface which will, advantageously, be stronger than the attachment of tools 48, 50, 52 to receiving magnet 16. Thus, tools 48, 50, 52 can be selectively removed and replaced without dislodging holder 10 from the work surface. In this regard, it is clear that numerous different types of conventional magnets are available, such as ceramic magnets, flexible or rubberized magnets or the like, and any combination of magnets suitable for the desired use of holder 10 is suitable according to the invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A magnetic tool holder, comprising:

a generally elongate body member having a first surface and a second surface and having a longitudinal channel running along at least a portion of the first surface;

a receiving magnet, disposed in the longitudinal channel; and detent means provided on the receiving magnet and the longitudinal channel, whereby the receiving magnet is held in place in the longitudinal channel when the detent means on the receiving magnet and the longitudinal channel are engaged.

2. A magnetic toolholder according to claim 1, further comprising means for mounting the tool holder, disposed on the second surface, whereby the tool holder can be mounted to a work surface.

3. A magnetic tool holder according to claim 2, wherein the mounting means includes a mounting magnet disposed on the second surface, whereby the tool holder can be magnetically mounted to a metallic work surface.

4. A magnetic tool holder according to claim 3, wherein the detent means includes at least one indentation disposed along at least one side of the receiving magnet, and at least one projection disposed along at least one inner side surface of the longitudinal channel for engaging the indentation of the receiving magnet.

5. A magnetic tool holder according to claim 4, further including plate means, disposed in the longitudinal channel between the receiving magnet and the inner side surfaces of the longitudinal channel, the plate means having dimple means disposed thereon for engaging with the detent means.

6. A magnetic tool holder according to claim 5, wherein the dimple means define at least one indented portion on one side of the plate means and define an extended portion on the other side of the plate means, wherein the projection of the longitudinal channel engages the indented portion of the plate means, and the extended portion of the plate means engages the at least one indentation of the receiving magnet, whereby the receiving magnet and the plate means are held in place in the longitudinal channel.

7. A magnetic tool holder according to claim 6, wherein the elongate body member comprises a generally flat base portion defining the first surface and the second surface, and having two substantially parallel arms extending from the first surface so as to define the longitudinal channel.

8. A magnetic tool holder according to claim 7, wherein the two substantially parallel arms extend substantially perpendicular to the first surface.

9. A magnetic tool holder according to claim 8, wherein the longitudinal channel has closed ends whereby the receiving magnet is further held within the longitudinal channel.

10. A magnetic tool holder according to claim 9, wherein the at least one projection includes projections disposed along both inwardly facing opposed surfaces of the substantially parallel arms.

11. A magnetic tool holder according to claim 10, wherein the plate means includes two substantially flat elongate plates, one plate being disposed between each side of the receiving magnet and a respective inwardly facing opposed surface of the substantially parallel arms, and wherein the dimple means are disposed along each plate at a spacing corresponding to the projections disposed along the inwardly facing opposed surfaces of the substantially parallel arms.

12. A magnetic tool holder according to claim 11, wherein the plate means further serve as pole pieces for augmenting magnetic attraction of the receiving magnet.

13. A magnetic tool holder according to claim 12, further including enclosure means disposed on the second surface of the body member, the enclosure means serving to position the mounting magnet on the second surface, the mounting magnet being disposed in the enclosure means.

14. A magnetic tool holder according to claim 13, wherein the enclosure means includes a wall formed on the second surface so as to at least partially enclose side surfaces of the mounting magnet, thereby holding the magnet against lateral movement relative to the second surface.

15. A magnetic tool holder according to claim 14, wherein the body member is made of a flexible material and wherein the mounting magnet includes a plurality of magnet segments, and the enclosure means includes walls formed on the second surface so as to at least partially enclose side surfaces of each magnet segment, whereby the magnet segments are movable relative to one another responsive to a flexing of the body member.

16. A magnetic tool holder according to claim 15, wherein the mounting magnet is a stronger magnet then the receiving magnet, whereby the tool holder can be affixed to a work surface and removal of a tool element from the receiving magnet will not dislodge the tool holder from the work surface.

* * * * *